US006868945B2

(12) United States Patent
Schuster et al.

(10) Patent No.: US 6,868,945 B2
(45) Date of Patent: Mar. 22, 2005

(54) METHOD FOR CONTROLLING AN ELEVATOR UTILIZING A MOBILE TELEPHONE

(75) Inventors: Kilian Schuster, Ballwil (CH); Paul Friedli, Remetschwil (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 10/275,122

(22) PCT Filed: Apr. 25, 2001

(86) PCT No.: PCT/CH01/00261

§ 371 (c)(1),
(2), (4) Date: Oct. 31, 2002

(87) PCT Pub. No.: WO01/83351

PCT Pub. Date: Nov. 8, 2001

(65) Prior Publication Data

US 2003/0159890 A1 Aug. 28, 2003

(30) Foreign Application Priority Data

May 1, 2000 (EP) ..... 00810367

(51) Int. Cl.[7] ..... B66B 1/16

(52) U.S. Cl. ..... 187/380; 187/384; 187/388; 187/391

(58) Field of Search ..... 187/380, 247, 187/384, 391, 386–389, 392

(56) References Cited

U.S. PATENT DOCUMENTS 5,736,692 A * 4/1998 Lumme et al. ..... 187/247
6,109,396 A * 8/2000 Sirag et al. ..... 187/381
6,202,799 B1 * 3/2001 Drop ..... 187/388
6,215,998 B1 * 4/2001 Stovall et al. ..... 455/423
6,223,160 B1 * 4/2001 Kostka et al. ..... 704/275
6,382,363 B1 * 5/2002 Friedli ..... 187/384
2004/0060777 A1 * 4/2004 Takeuchi ..... 187/391

FOREIGN PATENT DOCUMENTS

JP 01242374 A * 9/1989 ..... B66B/1/18

* cited by examiner

*Primary Examiner*—Jonathan Salata
(74) *Attorney, Agent, or Firm*—Schweitzer Cornman Gross & Bondell LLP

(57) ABSTRACT

The invention relates to the equipping of an elevator (1, 2) with hardware in order to control the same. This hardware is provided in the form of a customary radio telephone (3) which serves as a unit for controlling the elevator. The radio telephone (3), also designated as mobile, comprises a keypad (4) provided as a data entry unit, and comprises a display element (5), also named display, which is provided as a data output unit. The mobile (3) can wirelessly communicate with a mobile radio telephone network (6), whereby speech and/or data can be transmitted. The mobile radio telephone network (6) can contact other mobiles or a terminal (7) in order to transmit speech and/or data. The terminal (7) is comprised of a computer system, designated as server (8), which has access to a memory (9) containing elevator-specific and/or general information. The server (8) is also connected to the elevator system (1, 2) via an interface (10). The mobile (3), mobile radio telephone network (6) and terminal (7) form a human-machine interface between the user and the elevator system (1, 2).

7 Claims, 3 Drawing Sheets

INFO
SERVER
INTERFACE
ELEVATOR CONTROL
ELEVATOR
NETWORK
9
8
10
2
1
7
6
5
4
3

RADIO NETWORK 6
TERMINAL 7
ELEVATOR CONTROL 2
MAN
ELEVATOR INSTALLATION 1
NODE K3
CELL Z3
STORY 3 E3
1.1
NODE KA
STORY 1 E2
NODE K2
1.2
CELL Z2
CELL ZA
NODE KE
CELL ZE
CELL Z1
NODE K1
STORY 1 E1

Fig. 3

MAN Building

Welcome
Where do you want to go ?
- Departments
- People
- Floor

Fig. 4

MAN - Departments

- ADM Administration
- CHR Human Resources
- COM Communication
- FIN Finance
- LIE Real Estate

Fig. 5

MAN - Departments

Please contact Ms Spötl at
Room 6068, 6th Floor

- Call Ms Spötl
- Go to Ms Spötl

Fig. 6

MAN - Departments

Please contact Ms Spötl at
Room 6068, take

Car A to 6th Floor

Fig. 7

MAN - Departments

Please contact Ms Spötl at

Room 6068 (go left)

Fig. 8

MAN Building

Where do you want to go ?

- Back to Lobby
- Other Location

Fig. 9

MAN Building

Today at the MAN Building

- 09:00 R&D Information
- 15:00 COM Meeting

Fig. 10

MAN Building

EMERGENCY !

Please leave the Building as Fire is detected at 7th Floor.

METHOD FOR CONTROLLING AN ELEVATOR UTILIZING A MOBILE TELEPHONE

The invention relates to a method for controlling an elevator, wherein a user of the elevator communicates a travel request by means of a man/machine interface to the elevator which executes the desired journey.

BACKGROUND OF THE INVENTION

There has become known from patent specification U.S. Pat. No. 5,832,363 a communication system for transport equipment with elevators. A management plane superordinate to the transport equipment manages the transport equipment on the basis of specific operational data. If a potential user carries a radio telephone, his or her position is continuously ascertained. If the user moves to an elevator entry, an elevator car is ordered to the desired stopping point by the management plane.

A disadvantage of the known equipment resides in the fact that the user has to input his or her travel destination at the story or in the elevator car. In the case of crowding at the story or in the elevator car the user is stressed and loses time for the command input, whereby false inputs can also arise.

Here the invention will create a remedy. The invention fulfills the object of avoiding the disadvantages of the known equipment and of creating a method by which the control of an elevator installation is made more user-friendly.

BRIEF DESCRIPTIONS OF THE INVENTION

The advantages achieved by the invention are substantially to be seen in the fact that the user can use an individual control unit which is trusted by the user and which makes possible a locally fixed control by the user of the elevator installation. Moreover, there can be made available to the user, on the individual control unit, information about the elevator installation, the building and the use of the building. It is further of advantage that the user during the control and utilisation of the elevator installation is reachable at any time. The user can thus be assisted during the control and/or on his or her way with further information, such as, for example, details about transfer stories and changes in the car allocation, or with details and instructions relating to a fire situation. It is further advantageous that no or only a few locally fixed control units are necessary, because each user carries his or her own control unit therewith, which is also usable for other communications services.

The control unit is temporarily used for control of the elevator, wherein the control unit is provided for a specific time with functions which enable elevator control. For that purpose the necessary program and data are communicated to the control unit, are executed and evaluated therein and subsequently obliterated. By virtue of an identification of the control unit, this can be addressed by the elevator installation and information can be communicated thereto.

BRIEF DESCRIPTION OF THE DRAWINGS

The present invention is explained in more detail on the basis of the accompanying figures, in which:

FIG. 2 shows a local mobile radio network connected with the computer equipment and FIGS. 3 to 10 show a menu for control of the elevator installation and for informing the user.

DETAILED DESCRIPTION OF THE INVENTION

Figure 1:
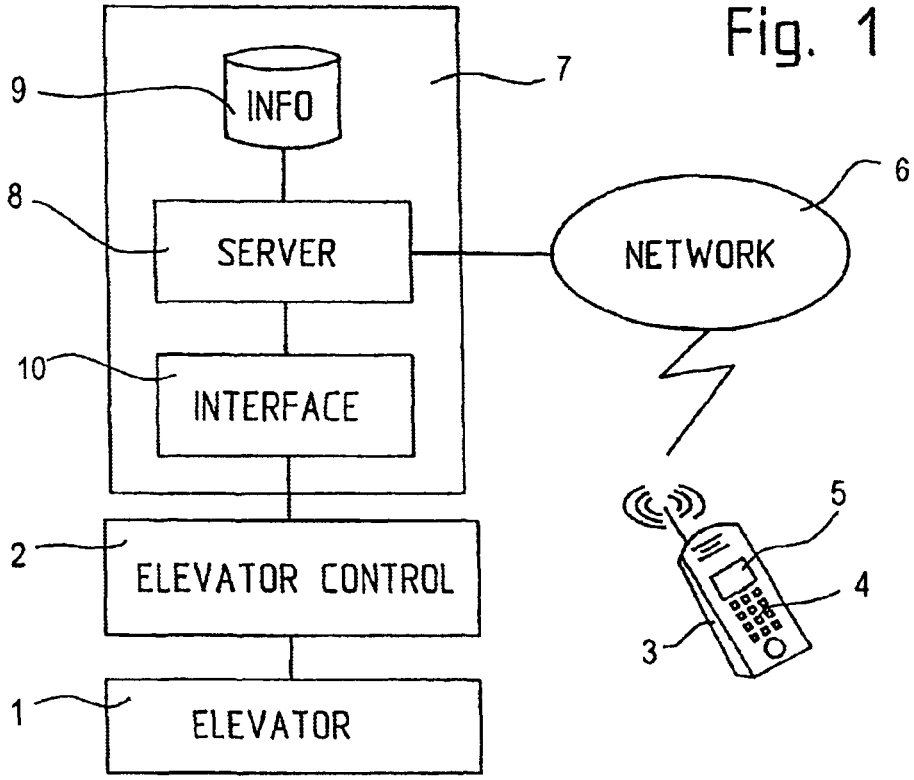
FIG. 1 shows computer equipment connected with an elevator installation and with a mobile radio network.

FIG. 1 shows the necessary hardware equipment for control of an elevator installation, which is denoted by 1 and 2, or of an elevator by means of a usual commercial radio telephone 3 as control unit for the elevator. The radio telephone 3, which is also termed mobile telephone, comprises a keyboard 4 provided as a data input unit and a display element 5, also called display, provided as a data output unit. The mobile 3 telephone can communicate in wire-free manner with a mobile radio network 6, wherein speech and/or data are transmissible. For the transmission of speech and/or data the mobile radio network can be placed in connection with further mobiles telephones or with computer equipment denoted as terminal 7. The terminal 7 consists of a computer system denoted as server 8, which has access to a memory 9 with elevator-specific and/or general information. The server 8 is also connected with the elevator installation 1, 2 by means of an interface 10. Mobile telephone 3, mobile radio network 6 and terminal 7 form a man/machine interface between the user and the elevator installation 1, 2.

Static information for elevator control, for example in the form of defined WML (Wireless Markup Language) pages and scripts is stored in the memory 9 and can be accessed by the server 8. Programs which can produce situation-induced information can also be filed in the memory 9. The server 8 can, in addition, make dynamic information and elevator functions available via interface 10. If the mobile telephone 3 is capable of interpreting information based on the WAP standard (Wireless Application Protocol), the information can be loaded at the mobile telephone 3 and made available at the mobile telephone 3. With the WAP standard the information is prepared for the mobile telephone in that graphical ballast is reduced and the information is optimised for small screens. The mobile telephone 3 must have available an interpreter denoted as a browser, by means of which the information can be loaded and the offered elevator capabilities utilized and the information represented.

For control of the elevator installation, the terminal 7 as a setting representative of the elevator installation 1, 2 is called up by the mobile telephone 3 according to its address. Thereupon the information (WML page) associated with the address is transmitted to the mobile telephone 3 and represented on the display 5 by means of the browser of the mobile telephone. If an elevator journey is desired, then the mobile 3 telephone demands corresponding WML pages from the server 8 and, if needed, supplementary WML scripts according to the WML page active in the mobile telephone 3. For preparation of this information the server 8 of the memory 9, which as explained further above contains the WML information and/or program for producing the WML information, serves itself. In addition, supplementary, elevator-specific information accessible by means of the interface 10 can be incorporated. The control of the elevator installation 1, 2 then takes place through selection on the WML page by means of the keyboard 4. As response to the selection the elevator installation 1, 2 makes available to the user further information, for example the elevator allocation in the case of an elevator group, the travel time, etc., via the WML page on the display 5.

The communication between mobile telephone 3 and server 8 is usually carried out in the manner that the information has to be expressly requested at the server 8 by the user by means of the mobile telephone browser. In the case of the WAP standard there is the new addition that the server 8 can transmits data to the browser without his making an express wish. The browser desires at the server 8 a WML initial page which usually enables all inputs necessary for an elevator journey, such as, for example, boarding story and destination story. After the data input a demand with the data goes to the server 8, which books the desired journey at the elevator control 2 and which obtains from the elevator control 2 the allocation of the elevator car. The server 8 combines this information with possible further information, such as WML content and transmits this to the mobile telephone browser.

Figure 2:
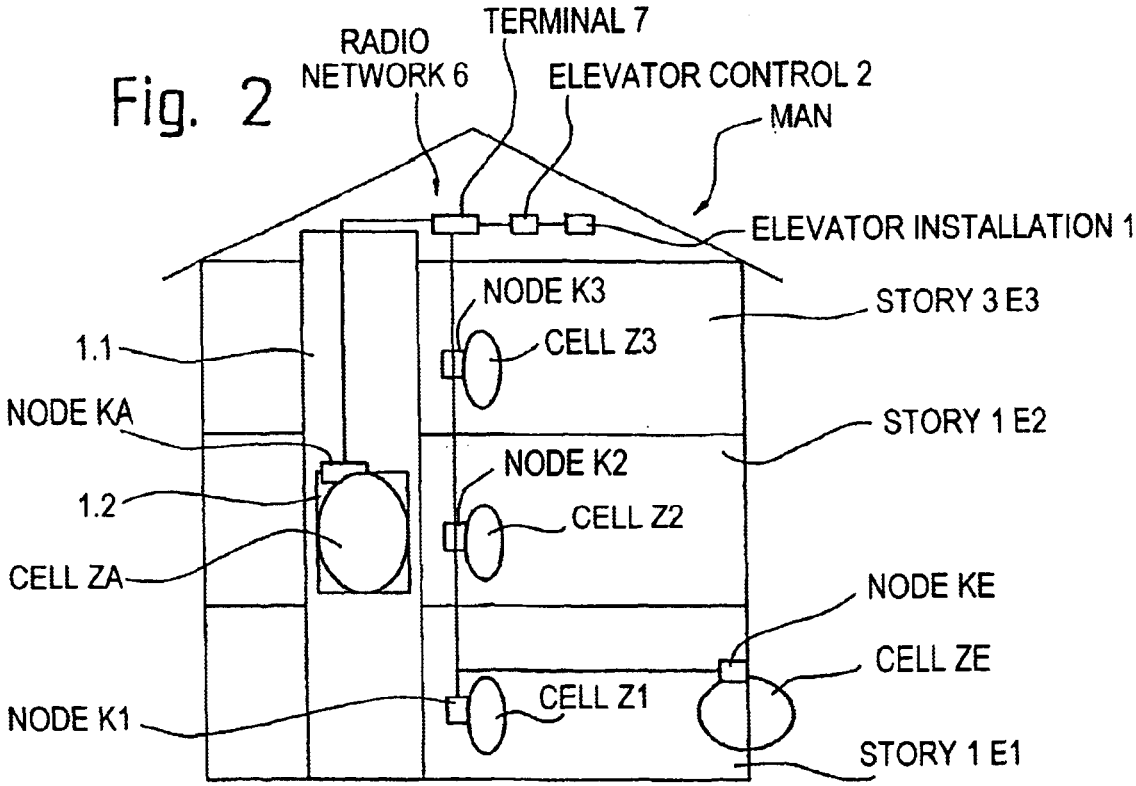

The mobile telephone 3 can, as shown in FIG. 1, communicate with a mobile radio network 6. The mobile radio network 6 can be a global or a publicly accessible mobile radio network 6 or, as illustrated in FIG. 2, a local mobile radio network 6. Global and local mobile radio networks 6 can also be operated in parallel. FIG. 2 shows a local mobile radio network 6 referred to a building MAN. The three stories E1, E2, E3 of the building MAN are connected with an elevator shaft 1.1, in which an elevator car 1.2 is movable. In the simplest case, the terminal 7 has available a local network 6 with a cell ZE in the entry region of the building MAN, with a respective cell Z1, Z2, Z3 in the lobby region of the elevator entrances and a cell ZA in the elevator car 1.2. Each cell ZE, Z1, Z2, Z3, ZA is produced by a nodal point KE, K1, K2, K3, KA based on, for example, Bluetooth technology. A nodal point KE, K1, K2, K3, KA produces a cell and is connected with the terminal 7. For production and reception of an electromagnetic field the nodal point comprises a transmitter/receiver unit with an antenna unit and a converter. The operative range of the nodal point corresponds with the cell. Bluetooth technology comprises a method for wireless communication by means of radio connection in the GHz region. In that case the transmission of data and speech is assisted and methods for formation of networks in the form of cells and cell compounds are provided. Through limitation of the transmission power, direct point-to-point connections are possible only at dose range. A mobile telephone with a Bluetooth module can communicate with the local mobile radio network 6 of FIG. 2 on the WAP standard.

If a user is detected within a locally distinct cell ZE, Z1, Z2, Z3, ZA, then the communication content between the control unit 3 and the terminal 7 is supplemented by the local information of the corresponding cell. The terminal 7 can then associate each user request with a specific local region.

Local information can also be obtained by a system for positional determination of the user, for example by GPS (Global Positioning System). The ascertained local information is transmitted to the server and used for construction and checking of the course of the controlling. With the local information, for example, the boarding story can be ascertained and/or guidance of the user within the building MAN, warning of the user in the case of going wrong, etc., can be managed.

Connections from the control unit 3 to building services external to the elevator are also possible if interfaces to the corresponding building services are present in the terminal 7 and the relevant WML contents are filed in the memory 9. Building services of domestic technology, such as, for example, control and checking of heating installations, lighting installations, doors, equipment for identification of users and access to the building, monitoring installations, internal building telephone networks, building information equipment, etc., are reachable from the control unit 3.

Communication between the control unit 3 and the terminal 7 can also comprise user-specific information, for example identification data of the user or data for release of special functions or user data which, for example, enables association of the costs for the elevator utilization.

FIGS. 3 to 10 show a menu-guided communication of the user with the terminal 7. On entering the building MAN, the user calls up the corresponding address of the elevator installation or building, whereupon the terminal 7 prepares the corresponding building information and delivers it to the mobile telephone 3. The information is made available to the user on the display 5 of the mobile telephone 3 in menu form. As shown in FIG. 3, the user knows which department he wants to visit. He selects the menu point 'Departments'. In FIG. 4 the interrogation is refined. The user wants to visit the personnel department and selects the corresponding department 'CHR'. As shown in FIG. 5, the terminal 7 recognizes the story of the personnel department and the contact person. The visitor wants to personally meet the contact person and consequently selects the second menu point of FIG. 5. The necessary parameters for the elevator journey are thus known. FIG. 6 shows the allocation of the elevator car. The user boards the elevator car A and travels to the story 6. As shown in FIG. 7, the user is informed in which office the contact person of the personnel department is to be met. With the menu according to FIG. 8 the user can seek other localities or leave the building. If the visitor wants to leave the building, an elevator car is assigned to him or her. Until departure from the building, the user is reachable by way of his or her address. In the case of need, further information can be made available to the user as shown in FIGS. 9 and 10. On leaving the building, the information made available in the mobile telephone 3 by the terminal 7 is erased. The mobile telephone 3 then again serves as an individual communication means of the user for speech and/or data.

What is claimed is:

1. A method of controlling an elevator, wherein a user of the elevator communicates a travel request by means of a man/machine interface to the elevator which executes the desired journey, comprising the steps of storing elevator control information in a memory associated with a telephone receiver at the elevator installation; establishing a communication link with the telephone receiver from a mobile telephone unit associated with a user of the elevator; transmitting to the mobile telephone the control information utilizing the control information to temporarily configure the mobile telephone as a remote control unit for the elevator to display and enable elevator control functions; transmitting control commands to the elevator from the mobile telephone to the telephone receiver; executing the commands at the elevator installation; and terminating the configuration of the mobile telephone as the remote control unit.

2. The method according to claim characterized in that computer equipment connected with the elevator communicates information with respect to control of the elevator by means of a radio network to the remote control unit, wherein the remote control unit represents the information to be comprehensible for the user and communicates instructions of the user to the computer equipment.

3. The method according to claim 1 or 2, characterized in that the communication between the remote control unit and the computer equipment takes place in accordance with WAP standard.

4. The method according to claim 3, characterized in that computer equipment communicates information with respect to control of the elevator to the control unit in dependence on user identification data.

5. The method according to claim 1 or 2, characterized in that the computer equipment communicates building information related to control of the elevator to the control unit.

6. The method according to claim 1 or 2, characterized in that the location of the control unit is determined and used as positional information for control of the elevator.

7. The method according to claim 1 or 2, characterized in that the information is used by the computer equipment for computation of travel costs.

* * * * *